US008991509B2

(12) United States Patent
Merron

(10) Patent No.: US 8,991,509 B2
(45) Date of Patent: Mar. 31, 2015

(54) DELAYED ACTIVATION ACTIVATABLE STIMULATION ASSEMBLY

(75) Inventor: Matthew James Merron, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 328 days.

(21) Appl. No.: 13/460,453

(22) Filed: Apr. 30, 2012

(65) Prior Publication Data

US 2013/0284451 A1 Oct. 31, 2013

(51) Int. Cl.

| | |
|---|---|
| ***E21B 34/14*** | (2006.01) |
| ***E21B 34/10*** | (2006.01) |
| ***E21B 43/26*** | (2006.01) |
| *E21B 34/00* | (2006.01) |

(52) U.S. Cl.

CPC ..... *E21B 34/108* (2013.01); *E21B 34/103* (2013.01); *E21B 34/14* (2013.01); *E21B 43/26* (2013.01); *E21B 2034/007* (2013.01)

USPC ..... 166/386; 166/383; 166/324

(58) Field of Classification Search

USPC ..... 166/383, 386, 324, 321; 251/50; 137/514.5, 514.7

See application file for complete search history.

(56) References Cited

U.S. PATENT DOCUMENTS

| | | | |
|---|---|---|---|
| 2,201,290 | A | 5/1940 | Greene |
| 2,493,650 | A | 1/1950 | Baker et al. |
| 2,537,066 | A | 1/1951 | Lewis |
| 2,627,314 | A | 2/1953 | Baker et al. |
| 2,913,051 | A | 11/1959 | Lister |
| 3,054,415 | A | 9/1962 | Baker et al. |
| 3,057,405 | A | 10/1962 | Mallinger |
| 3,151,681 | A | 10/1964 | Cochran |
| 3,216,497 | A | 11/1965 | Howard et al. |
| 3,295,607 | A | 1/1967 | Sutliff |
| 3,363,696 | A | 1/1968 | Berryman |

(Continued)

FOREIGN PATENT DOCUMENTS

| | | | |
|---|---|---|---|
| AU | 2012200380 | A1 | 2/2012 |
| CA | 2778311 | A1 | 5/2011 |

(Continued)

OTHER PUBLICATIONS

Foreign communication from a related counterpart application—International Search Report and Written Opinion, PCT/US2012/050564, Feb. 14, 2014, 16 pages.

(Continued)

*Primary Examiner* — Cathleen Hutchins

(74) *Attorney, Agent, or Firm* — John W. Wustenberg; Baker Botts L.L.P.

(57) ABSTRACT

A wellbore servicing apparatus comprising a housing defining an axial flowbore and comprising one or more ports providing a route of fluid communication between the axial flowbore and an exterior of the housing, a sliding sleeve disposed within the housing and comprising a seat and an orifice, the sliding sleeve being movable from a first position in which the ports are obstructed by the sliding sleeve to a second position in which the ports are unobstructed by the sliding sleeve, and the seat being configured to engage and retain an obturating member, and a fluid delay system comprising a fluid chamber containing a fluid, wherein the fluid delay system is operable to allow the sliding sleeve to transition from the first position to the second position at a delayed rate.

23 Claims, 4 Drawing Sheets

(56) References Cited

U.S. PATENT DOCUMENTS 3,434,537 A 3/1969 Zandmer
3,662,825 A 5/1972 Nutter
3,662,826 A 5/1972 Young et al.
3,768,556 A 10/1973 Baker
3,850,238 A 11/1974 Hill
4,047,564 A 9/1977 Nix et al.
4,081,990 A 4/1978 Chatagnier
4,105,069 A 8/1978 Baker
4,109,725 A 8/1978 Williamson et al.
4,150,994 A 4/1979 Maternaghan
4,196,782 A 4/1980 Blanton
4,373,582 A 2/1983 Bednar et al.
4,417,622 A 11/1983 Hyde
4,469,136 A 9/1984 Watkins
4,605,074 A 8/1986 Barfield
4,673,039 A 6/1987 Mohaupt
4,691,779 A * 9/1987 McMahan et al. ..... 166/321
4,714,117 A 12/1987 Dech
4,771,831 A 9/1988 Pringle et al.
4,842,062 A 6/1989 Schneider et al.
4,893,678 A 1/1990 Stokley et al.
5,125,582 A 6/1992 Surjaatmadja et al.
5,127,472 A 7/1992 Watson et al.
5,137,086 A 8/1992 Stokley et al.
5,156,220 A 10/1992 Forehand et al.
5,180,016 A 1/1993 Ross et al.
5,193,621 A 3/1993 Manke et al.
5,289,875 A 3/1994 Stokley et al.
5,314,032 A 5/1994 Pringle et al.
5,323,856 A 6/1994 Davis et al.
5,325,917 A 7/1994 Szarka
5,325,923 A 7/1994 Surjaatmadja et al.
5,361,856 A 11/1994 Surjaatmadja et al.
5,366,015 A 11/1994 Surjaatmadja et al.
5,375,662 A 12/1994 Echols, III et al.
5,381,862 A 1/1995 Szarka et al.
5,396,957 A 3/1995 Surjaatmadja et al.
5,425,424 A 6/1995 Reinhardt et al.
5,484,016 A 1/1996 Surjaatmadja et al.
5,494,103 A 2/1996 Surjaatmadja et al.
5,494,107 A 2/1996 Bode
5,499,678 A 3/1996 Surjaatmadja et al.
5,499,687 A 3/1996 Lee
5,533,571 A 7/1996 Surjaatmadja et al.
5,558,153 A 9/1996 Holcombe et al.
5,732,776 A 3/1998 Tubel et al.
5,765,642 A 6/1998 Surjaatmadja
5,826,661 A 10/1998 Parker et al.
5,865,252 A 2/1999 Van Petegem et al.
5,865,254 A 2/1999 Huber et al.
5,927,401 A 7/1999 Morris et al.
5,944,105 A 8/1999 Nguyen
5,947,198 A 9/1999 McKee et al.
5,947,205 A 9/1999 Shy
5,960,881 A 10/1999 Allamon et al.
6,000,468 A 12/1999 Pringle
6,003,834 A 12/1999 Read
6,006,838 A 12/1999 Whiteley et al.
6,041,864 A 3/2000 Patel et al.
6,116,343 A 9/2000 Van Petegem et al.
6,119,783 A 9/2000 Parker et al.
6,145,593 A 11/2000 Hennig
6,152,232 A 11/2000 Webb et al.
6,167,974 B1 1/2001 Webb
6,189,618 B1 2/2001 Beeman et al.
6,216,785 B1 4/2001 Achee, Jr. et al.
6,230,811 B1 5/2001 Ringgenberg et al.
6,241,015 B1 * 6/2001 Pringle et al. ..... 166/66.4
6,244,342 B1 6/2001 Sullaway et al.
6,253,861 B1 7/2001 Carmichael et al.
6,257,339 B1 7/2001 Haugen et al.
6,286,599 B1 9/2001 Surjaatmadja et al.
6,318,469 B1 11/2001 Patel
6,318,470 B1 11/2001 Chang et al.
6,336,502 B1 1/2002 Surjaatmadja et al.
6,343,658 B2 2/2002 Webb
6,359,569 B2 3/2002 Beck et al.
6,422,317 B1 7/2002 Williamson, Jr.
6,453,997 B1 9/2002 McNeilly et al.
6,467,541 B1 10/2002 Wells
6,494,264 B2 12/2002 Pringle et al.
6,520,257 B2 2/2003 Allamon et al.
6,543,538 B2 4/2003 Tolman et al.
6,561,277 B2 5/2003 Algeroy et al.
6,571,875 B2 6/2003 Bissonnette et al.
6,634,428 B2 10/2003 Krauss et al.
6,662,874 B2 12/2003 Surjaatmadja et al.
6,662,877 B2 12/2003 Patel
6,712,160 B1 3/2004 Schultz et al.
6,719,054 B2 4/2004 Cheng et al.
6,722,427 B2 4/2004 Gano et al.
6,725,933 B2 4/2004 Middaugh et al.
6,769,490 B2 8/2004 Allamon et al.
6,776,238 B2 8/2004 Dusterhoft et al.
6,779,607 B2 8/2004 Middaugh et al.
6,787,758 B2 9/2004 Tubel et al.
6,789,619 B2 9/2004 Carlson et al.
6,802,374 B2 10/2004 Edgar et al.
6,907,936 B2 6/2005 Fehr et al.
6,923,255 B2 8/2005 Lee
6,938,690 B2 9/2005 Surjaatmadja
6,997,252 B2 2/2006 Porter et al.
6,997,263 B2 2/2006 Campbell et al.
7,013,971 B2 3/2006 Griffith et al.
7,021,384 B2 4/2006 Themig
7,021,389 B2 4/2006 Bishop et al.
7,055,598 B2 6/2006 Ross et al.
7,066,265 B2 6/2006 Surjaatmadja
7,090,153 B2 8/2006 King et al.
7,096,954 B2 8/2006 Weng et al.
7,108,067 B2 9/2006 Themig et al.
7,134,505 B2 11/2006 Fehr et al.
7,159,660 B2 1/2007 Justus
7,168,493 B2 1/2007 Eddison
7,195,067 B2 3/2007 Manke et al.
7,219,730 B2 5/2007 Tilton et al.
7,225,869 B2 6/2007 Willett et al.
7,228,908 B2 6/2007 East, Jr. et al.
7,234,529 B2 6/2007 Surjaatmadja
7,237,612 B2 7/2007 Surjaatmadja et al.
7,243,723 B2 7/2007 Surjaatmadja et al.
7,252,147 B2 8/2007 Badalamenti et al.
7,252,152 B2 8/2007 LoGiudice et al.
7,273,099 B2 9/2007 East, Jr. et al.
7,278,486 B2 10/2007 Alba et al.
7,287,592 B2 10/2007 Surjaatmadja et al.
7,290,611 B2 11/2007 Badalamenti et al.
7,296,625 B2 11/2007 East, Jr.
7,303,008 B2 12/2007 Badalamenti et al.
7,306,043 B2 12/2007 Toekje et al.
7,322,412 B2 1/2008 Badalamenti et al.
7,322,417 B2 1/2008 Rytlewski et al.
7,325,617 B2 2/2008 Murray
7,337,844 B2 3/2008 Surjaatmadja et al.
7,337,847 B2 3/2008 McGarian et al.
7,343,975 B2 3/2008 Surjaatmadja et al.
7,353,878 B2 4/2008 Themig
7,353,879 B2 4/2008 Todd et al.
7,377,321 B2 5/2008 Rytlewski
7,377,322 B2 5/2008 Hofman
7,385,523 B2 6/2008 Thomeer et al.
7,387,165 B2 6/2008 Lopez de Cardenas et al.
7,398,825 B2 7/2008 Nguyen et al.
7,416,029 B2 8/2008 Telfer et al.
7,419,002 B2 9/2008 Dybevik et al.
7,422,060 B2 9/2008 Hammami et al.
7,431,090 B2 10/2008 Surjaatmadja et al.
7,431,091 B2 10/2008 Themig et al.
7,464,764 B2 12/2008 Xu
7,478,676 B2 1/2009 East, Jr. et al.
7,503,390 B2 3/2009 Gomez
7,503,398 B2 3/2009 LoGiudice et al.
7,506,689 B2 3/2009 Surjaatmadja et al.
7,510,010 B2 3/2009 Williamson

(56) References Cited

U.S. PATENT DOCUMENTS

| | | | |
|---|---|---|---|
| 7,510,017 | B2 | 3/2009 | Howell et al. |
| 7,520,327 | B2 | 4/2009 | Surjaatmadja |
| 7,527,103 | B2 | 5/2009 | Huang et al. |
| 7,543,641 | B2 | 6/2009 | Contant |
| 7,571,766 | B2 | 8/2009 | Pauls et al. |
| 7,575,062 | B2 | 8/2009 | East, Jr. |
| 7,617,871 | B2 | 11/2009 | Surjaatmadja et al. |
| 7,621,337 | B2 | 11/2009 | Badalamenti et al. |
| 7,628,213 | B2 | 12/2009 | Telfer |
| 7,637,323 | B2 | 12/2009 | Schasteen et al. |
| 7,644,772 | B2 | 1/2010 | Avant et al. |
| 7,661,478 | B2 | 2/2010 | Palmer et al. |
| 7,665,545 | B2 | 2/2010 | Telfer |
| 7,673,673 | B2 | 3/2010 | Surjaatmadja et al. |
| 7,673,677 | B2 | 3/2010 | King et al. |
| 7,681,645 | B2 | 3/2010 | McMillin et al. |
| 7,703,510 | B2 | 4/2010 | Xu |
| 7,735,559 | B2 | 6/2010 | Malone |
| 7,740,072 | B2 | 6/2010 | Surjaatmadja |
| 7,740,079 | B2 | 6/2010 | Clayton et al. |
| 7,748,460 | B2 | 7/2010 | Themig et al. |
| 7,775,285 | B2 | 8/2010 | Surjaatmadja et al. |
| 7,779,906 | B2 | 8/2010 | Porter et al. |
| 7,802,627 | B2 | 9/2010 | Hofman et al. |
| 7,849,924 | B2 | 12/2010 | Surjaatmadja et al. |
| 7,849,925 | B2 | 12/2010 | Patel |
| 7,861,788 | B2 | 1/2011 | Tips et al. |
| 7,866,396 | B2 | 1/2011 | Rytlewski |
| 7,866,402 | B2 | 1/2011 | Williamson, Jr. |
| 7,866,408 | B2 | 1/2011 | Allison et al. |
| 7,870,907 | B2 | 1/2011 | Lembcke et al. |
| 7,878,255 | B2 | 2/2011 | Howell et al. |
| 7,909,108 | B2 | 3/2011 | Swor et al. |
| 7,926,571 | B2 | 4/2011 | Hofman |
| 7,934,559 | B2 | 5/2011 | Posevina et al. |
| 7,938,186 | B1 | 5/2011 | Badalamenti et al. |
| 7,946,340 | B2 | 5/2011 | Surjaatmadja et al. |
| 7,963,331 | B2 | 6/2011 | Surjaatmadja et al. |
| 7,967,067 | B2 | 6/2011 | Irani et al. |
| 8,162,050 | B2 | 4/2012 | Roddy et al. |
| 8,186,444 | B2 | 5/2012 | Patel |
| 8,191,625 | B2 | 6/2012 | Porter et al. |
| 8,215,411 | B2 | 7/2012 | Flores et al. |
| 8,245,788 | B2 | 8/2012 | Garcia et al. |
| 8,267,178 | B1 | 9/2012 | Sommers et al. |
| 8,276,674 | B2 | 10/2012 | Lopez de Cardenas et al. |
| 8,276,675 | B2 | 10/2012 | Williamson et al. |
| 8,291,980 | B2 | 10/2012 | Fay |
| 8,297,367 | B2 | 10/2012 | Chen et al. |
| 8,307,913 | B2 | 11/2012 | Dolman et al. |
| 8,316,951 | B2 | 11/2012 | Fay et al. |
| 8,365,824 | B2 | 2/2013 | Phillips |
| 8,408,314 | B2 | 4/2013 | Patel et al. |
| 8,418,769 | B2 | 4/2013 | Fay et al. |
| 8,496,055 | B2 | 7/2013 | Mootoo et al. |
| 8,505,639 | B2 | 8/2013 | Robison et al. |
| 8,534,369 | B2 | 9/2013 | deBoer |
| 8,540,035 | B2 | 9/2013 | Xu et al. |
| 8,757,265 | B1 | 6/2014 | Cuffe et al. |
| 2003/0029611 | A1 | 2/2003 | Owens |
| 2005/0263279 | A1* | 12/2005 | Vachon ..... 166/250.01 |
| 2006/0086507 | A1 | 4/2006 | Surjaatmadja et al. |
| 2006/0157257 | A1 | 7/2006 | Ross et al. |
| 2007/0102156 | A1 | 5/2007 | Nguyen et al. |
| 2007/0261851 | A1 | 11/2007 | Surjaatmadja |
| 2007/0272411 | A1 | 11/2007 | Lopez de Cardenas et al. |
| 2007/0272413 | A1 | 11/2007 | Rytlewski et al. |
| 2007/0284114 | A1 | 12/2007 | Swor et al. |
| 2008/0000637 | A1 | 1/2008 | McDaniel et al. |
| 2008/0060810 | A9 | 3/2008 | Nguyen et al. |
| 2008/0135248 | A1 | 6/2008 | Talley et al. |
| 2008/0202764 | A1 | 8/2008 | Clayton et al. |
| 2008/0264641 | A1 | 10/2008 | Slabaugh et al. |
| 2009/0084553 | A1 | 4/2009 | Rytlewski et al. |
| 2009/0090501 | A1 | 4/2009 | Hansen et al. |
| 2009/0223670 | A1 | 9/2009 | Snider |
| 2009/0308588 | A1 | 12/2009 | Howell et al. |
| 2010/0000727 | A1 | 1/2010 | Webb et al. |
| 2010/0044041 | A1 | 2/2010 | Smith et al. |
| 2010/0155055 | A1 | 6/2010 | Ash et al. |
| 2010/0200243 | A1 | 8/2010 | Purkis |
| 2010/0200244 | A1 | 8/2010 | Purkis |
| 2011/0036590 | A1 | 2/2011 | Williamson et al. |
| 2011/0100643 | A1 | 5/2011 | Themig et al. |
| 2011/0108272 | A1 | 5/2011 | Watson et al. |
| 2011/0147088 | A1 | 6/2011 | Brunet et al. |
| 2011/0155380 | A1 | 6/2011 | Frazier |
| 2011/0155392 | A1 | 6/2011 | Frazier |
| 2011/0180269 | A1 | 7/2011 | Vestavik |
| 2011/0192607 | A1 | 8/2011 | Hofman et al. |
| 2011/0253383 | A1 | 10/2011 | Porter et al. |
| 2011/0278017 | A1 | 11/2011 | Themig et al. |
| 2012/0061105 | A1 | 3/2012 | Neer et al. |
| 2012/0111574 | A1 | 5/2012 | Desranleau et al. |
| 2012/0160515 | A1 | 6/2012 | Braekke et al. |
| 2013/0008647 | A1 | 1/2013 | Dirksen et al. |
| 2013/0048290 | A1 | 2/2013 | Howell et al. |
| 2013/0048291 | A1 | 2/2013 | Merron et al. |
| 2013/0048298 | A1 | 2/2013 | Merron et al. |
| 2013/0255938 | A1 | 10/2013 | Neer |
| 2014/0158370 | A1 | 6/2014 | Porter et al. |
| 2014/0166290 | A1 | 6/2014 | Howell |

FOREIGN PATENT DOCUMENTS

| | | | |
|---|---|---|---|
| CN | 102518418 | A | 6/2012 |
| CN | 102518420 | A | 6/2012 |
| EP | 2216500 | A2 | 8/2010 |
| GB | 2321659 | A | 8/1998 |
| GB | 2323871 | A | 10/1998 |
| GB | 2332006 | A | 6/1999 |
| GB | 2415213 | B | 1/2009 |
| WO | 0246576 | A1 | 6/2002 |
| WO | 2004088091 | A1 | 10/2004 |
| WO | 2008070051 | A2 | 6/2008 |
| WO | 2008070051 | A3 | 6/2008 |
| WO | 2008070051 | B1 | 6/2008 |
| WO | 2008071912 | A1 | 6/2008 |
| WO | 2008093047 | A1 | 8/2008 |
| WO | 2009019461 | A1 | 2/2009 |
| WO | 2009029437 | A1 | 3/2009 |
| WO | 2009132462 | A1 | 11/2009 |
| WO | 2010001087 | A2 | 1/2010 |
| WO | 2010001087 | A3 | 1/2010 |
| WO | 2010058160 | A1 | 5/2010 |
| WO | 2010127457 | A1 | 11/2010 |
| WO | 2010128291 | A2 | 11/2010 |
| WO | 2010149644 | A1 | 12/2010 |
| WO | 2011018623 | A2 | 2/2011 |
| WO | 2011018623 | A3 | 2/2011 |
| WO | 2011058325 | A2 | 5/2011 |
| WO | 2011058325 | A3 | 5/2011 |
| WO | 2012037646 | A1 | 3/2012 |
| WO | 2012107730 | A2 | 8/2012 |
| WO | 2012107730 | A3 | 8/2012 |
| WO | 2012107730 | A8 | 8/2012 |
| WO | 2012107731 | A2 | 8/2012 |
| WO | 2012107731 | A3 | 8/2012 |
| WO | 2012164236 | A1 | 12/2012 |
| WO | 2013028385 | A2 | 2/2013 |
| WO | 2013028385 | A3 | 2/2013 |
| WO | 2013048696 | A1 | 4/2013 |
| WO | 2013165643 | A2 | 11/2013 |
| WO | 2013165643 | A3 | 11/2013 |
| WO | 2014004144 | A2 | 1/2014 |

OTHER PUBLICATIONS

Office Action dated Feb. 25, 2014 (79 pages), U.S. Appl. No. 13/156,155, filed Jun. 8, 2011.

Filing receipt and specification entitled "A Method for Individually Servicing a Plurality of Zones of a Subterranean Formation," by Matthew Todd Howell, filed Feb. 24, 2014 as U.S. Appl. No. 14/187,761.

(56) References Cited

OTHER PUBLICATIONS

Office Action dated Jun. 18, 2013 (41 pages), U.S. Appl. No. 13/025,041, filed Feb. 10, 2011.
Office Action dated Jun. 18, 2013 (40 pages), U.S. Appl. No. 13/151,457, filed Jun. 2, 2011.
Foreign communication from a related counterpart application—International Search Report and Written Opinion, PCT/GB2012/000140, May 30, 2012, 11 pages.
Patent application entitled "System and Method for Servicing a Wellbore," by Adam Kent Neer, filed Jun. 29, 2012 as U.S. Appl. No. 13/538,911.
Notice of Allowance dated Jul. 9, 2012 (11 pp.), Application U.S. Appl. No. 12/617,405 filed Nov. 12, 2009.
Notice of Allowance dated Jul. 25, 2012 (9 pp.), Application U.S. Appl. No. 12/539,392 filed on Aug. 11, 2009.
Supplemental Notice of Allowability dated Aug. 22, 2012 (6 pp.), Application U.S. Appl. No. 12/539,392 filed on Aug. 11, 2009.
Office Action (Final) dated Oct. 11, 2013 (17 pages), U.S. Appl. No. 13/025,039, filed Feb. 10, 2011.
Foreign communication from a related counterpart application—International Search Report and Written Opinion, PCT/US2013/035122, Dec. 18, 2013, 13 pages.
Foreign communication from a related counterpart application—International Search Report and Written Opinion, PCT/US2013/046109, Dec. 18, 2013, 10 pages.
"Omega Tracer Deployment Valve (TDV)," XP054975262, Oct. 2, 2009, 1 page, http://www.youtube.com/watch? v=9nBh22_7EfA, Omega Completion Technology, Ltd.
Foreign communication from a related counterpart application—International Preliminary Report on Patentability, PCT/GB2012/000140, Dec. 2, 2013, 6 pages.
Foreign communication from a related counterpart application—International Preliminary Report on Patentability, PCT/GB2008/002646, Feb. 9, 2010, 6 pages.
Foreign communication from a related counterpart application—International Preliminary Report on Patentability, PCT/GB2007/004628, Jun. 16, 2009, 6 pages.
Foreign communication from a related counterpart application—International Preliminary Report on Patentability, PCT/GB2009/001505, Feb. 15, 2011, 5 pages.
Foreign communication from a related counterpart application—International Preliminary Report on Patentability, PCT/GB2009/002693, May 24, 2011, 6 pages.
Foreign communication from a related counterpart application—International Preliminary Report on Patentability, PCT/GB2010/001524, Feb. 14, 2012, 7 pages.
Foreign communication from a related counterpart application—International Preliminary Report on Patentability, PCT/GB2010/002090, May 15, 2012, 8 pages.
Foreign communication from a related counterpart application—International Preliminary Report on Patentability, PCT/GB2012/000139, Aug. 13, 2013, 6 pages.
Foreign communication from a related counterpart application—International Preliminary Report on Patentability, PCT/GB2012/000141, Aug. 13, 2013, 7 pages.
Office Action dated Feb. 4, 2014 (61 pages), U.S. Appl. No. 13/215,553, filed Aug. 23, 2011.
Filing receipt and specification entitled "System and Method for Servicing a Wellbore," by Jesse Cale Porter, et al., filed Jan. 15, 2014 as U.S. Appl. No. 14/156,232.
Foreign communication from a related counterpart application—International Search Report and Written Opinion, PCT/GB2012/000141, Dec. 20, 2012, 11 pages.
Foreign communication from a related counterpart application—International Search Report and Written Opinion, PCT/GB2012/000139, Dec. 19, 2012, 11 pages.
Foreign communication from a related counterpart application—International Search Report and Written Opinion, PCT/US2012/054161, Feb. 8, 2013, 11 pages.
Office Action (Final) dated May 22, 2014 (15 pages), U.S. Appl. No. 13/215,553, filed Aug. 23, 2011.
Foreign communication from a related counterpart application—Invitation to Pay Additional Fees, PCT/US2012/050564, Nov. 5, 2013, 4 pages.
Foreign communication from a related counterpart application—International Search Report and Written Opinion, PCT/GB2008/002646, Dec. 11, 2008, 8 pages.
Foreign Communication from a related counterpart application—International Search Report and Written Opinion, PCT/GB2007/004628, Feb. 26, 2008, 8 pages.
Foreign commuunication from a related counterpart application—International Search Report and Written Opinion, PCT/GB2009/001505, Feb. 8, 2011, 8 pages.
Foreign communication from a related counterpart application—International Search Report and Written Opinion, PCT/GB2009/002693, Mar. 2, 2010, 8 pages.
Foreign communication from a related counterpart application—International Search Report and Written Opinion, PCT/GB2010/001524, Apr. 13, 2011, 11 pages.
Foreign communication from a related counterpart application—International Search Report and Written Opinion, PCT/GB2010/002090, Aug. 12, 2011, 11 pages.
Halliburton brochure entitled "Delta Stim® Completion Service," Sep. 2008, 4 pages, Halliburton.
Halliburton brochure entitled "Delta Stim™ Sleeve," Mar. 2007, 2 pages, Halliburton.
Halliburton brochure entitled "Swellpacker® cable system," Aug. 2008, 2 pages, Halliburton.
Halliburton brochure entitled "RapidFrac198 System," Mar. 2011, 3 pages.
Halliburton brochure entitled "sFrac™ Valve," Jun. 2010, 3 pages, Halliburton.
Halliburton Marketing Data Sheet, Sand Control, EquiFlow™ Inflow Control Devices, HO5600,01/08, pp. 1-2.
The Lee Company brochure entitled "Meet the EFS family," http://www.theleeco.com/EFSWEB2.Nsf/Products! OpenPage, Apr. 21, 2009, 1 page.
The Lee Company brochure entitled "Meet the precision microhydraulics family," http://www.theleeco.com/LEEWEB2.NSF/AeroStart!OpenPage, Apr. 21, 2009, 2 page.
Lohm calculator for gas flow, http://www.theleeco.com/EFSWEB2.NSF/airlohms.htm, Apr. 21, 2009, 2 pages, courtesy of the Lee Company.
Lohm calculator for liquid flow, http://www.theleeco.com/EFSWEB2.NSF/flowcalc.htm, Apr. 21, 2009, 2 pages, courtesy of the Lee Company.
Office Action (Final) dated Sep. 15, 2009 (12 pages), U.S. Appl. No. 11/609,128, filed Dec. 11, 2006.
Office Action dated Feb. 18, 2009 (18 pages), U.S. Appl. No. 11/609,128, filed Dec. 11, 2006.
Office Action dated Jun. 24, 2010 (13 pages), U.S. Appl. No. 12/139,604, filed Jun. 16, 2008.
Office Action dated Dec. 22, 2009 (18 pages), U.S. Appl. No. 12/139,604, filed Jun. 16, 2008.
Office Action (Final) dated Aug. 12, 2011 (12 pages), U.S. Appl. No. 12/166,257, filed Jul. 1, 2008.
Office Action dated Mar. 31, 2011 (19 pages), U.S. Appl. No. 12/166,257, filed Jul. 1, 2008.
Office Action dated Aug. 9, 2011 (24 pages), U.S. Appl. No. 12/539,392, filed Aug. 11, 2009.
Office Action dated Apr. 4, 2012 (21 pages), U.S. Appl. No. 12/539,392, filed Aug. 11, 2009.
Office Action dated Mar. 28, 2012 (39 pages), U.S. Appl. No. 12/617,405, filed Nov. 12, 2009.
Packers Plus brochure entitled "Achieve immediate production; StackFRAC® HD," Mar. 11, 2011, 4 pages.
Packers Plus brochure entitled "High Density Multi-Stage Fracturing System; StackFRAC® HD," Apr. 20, 2010, 2 pages.
Packers Plus® Case Study entitled "Packers Plus launches the StackFRAC® HD "High Density" Multi-Stage Fracturing System to fulfill operator demand for more stimulation stages to increase production," 1 page.

(56) References Cited

OTHER PUBLICATIONS

Patent application entitled "A Method for individually servicing a plurality of zones of a subterranean formation," by Matthew Todd Howell, filed Feb. 10, 2011 as U.S. Appl. No. 13/025,039.
Patent application entitled "System and method for servicing a wellbore," by Jesse Cale Porter, et al., filed Feb. 10, 2011 as U.S. Appl. No. 13/025,041.
Patent application entitled "System and method for servicing a wellbore," by Jesse Cale Porter, et al., filed Jun. 2, 2011 as U.S. Appl. No. 13/151,457.
Patent application entitled "System and method for servicing a wellbore," by Matthew James Merron, et al., filed Aug. 23, 2011 as U.S. Appl. No. 13/215,553.
Patent application entitled "Responsively activated wellbore stimulation assemblies and methods of using the same," by Brock William Miller, filed Jun. 8, 2011 as U.S. Appl. No. 13/156,155.
Patent application entitled "Responsively activated wellbore stimulation assemblies and methods of using the same," by William Mark Norrid, et al., filed Sep. 29, 2011 as U.S. Appl. No. 13/248,145.
Office Action dated May 8, 2013 (51 pages), U.S. Appl. No. 13/025,039, filed Feb. 10, 2011.
Office Action dated Jul. 30, 2014 (99 pages), U.S. Appl. No. 13/538,911, filed Jun. 29, 2012.
Notice of Allowance dated Aug. 11, 2014 (20 pages), U.S. Appl. No. 13/156,155. filed Jun. 8, 2011.
Foreign communication from a related counterpart application—Chinese Office Action with English translation, Application No. 201080059511.0, Mar. 5, 2014, 21 pages.
Foreign communication from a related counterpart application—Australian Examination Report, Application No. 2010317706, May 21, 2014, 4 pages.
Foreign communication from a related counterpart application—Canadian Office Action, CA 2,768,756, Apr. 24, 2014, 2 pages.
Foreign communication from a related counterpart application—International Search Report and Written Opinion, PCT/GB2010/001524, Apr. 13, 2011, 10 pages.
Foreign communication from a related counterpart application—International Preliminary Report on Patentability, PCT/US2012/054161, Apr. 1, 2014, 6 pages.

* cited by examiner

DELAYED ACTIVATION ACTIVATABLE STIMULATION ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

Additionally, in some wellbores, it may be desirable to individually and selectively create multiple fractures along a wellbore at a distance apart from each other, creating multiple "pay zones." The multiple fractures should have adequate conductivity, so that the greatest possible quantity of hydrocarbons in an oil and gas reservoir can be produced from the wellbore. Some pay zones may extend a substantial distance along the length of a wellbore. In order to adequately induce the formation of fractures within such zones, it may be advantageous to introduce a stimulation fluid via multiple stimulation assemblies positioned within a wellbore adjacent to multiple zones. To accomplish this, it is necessary to configure multiple stimulation assemblies for the communication of fluid via those stimulation assemblies.

An activatable stimulation tool may be employed to allow selective access to one or more zones along a wellbore. However, it is not always apparent when or if a particular one, of sometimes several, of such activatable stimulation tools has, in fact, been activated, thereby allowing access to a particular zone of a formation. As such, where it is unknown whether or not a particular downhole tool has been activated, it cannot be determined if fluids thereafter communicated into a wellbore, for example in the performance of a servicing operation, will reach the formation zone as intended.

As such, there exists a need for a downhole tool, particularly, an activatable stimulation tool, capable of indicating to an operator that it, in particular, has been activated and will function as intended, as well as methods of utilizing the same in the performance of a wellbore servicing operation.

SUMMARY

Disclosed herein is a wellbore servicing apparatus comprising a housing defining an axial flowbore and comprising one or more ports providing a route of fluid communication between the axial flowbore and an exterior of the housing, a sliding sleeve disposed within the housing and comprising a seat and an orifice, the sliding sleeve being movable from a first position in which the ports are obstructed by the sliding sleeve to a second position in which the ports are unobstructed by the sliding sleeve, and the seat being configured to engage and retain an obturating member, and a fluid delay system comprising a fluid chamber containing a fluid, wherein the fluid delay system is operable to allow the sliding sleeve to transition from the first position to the second position at a delayed rate.

Also disclosed herein is a wellbore servicing method comprising positioning a casing string within a wellbore, the casing string having incorporated therein a wellbore servicing apparatus, the wellbore servicing apparatus comprising a housing defining an axial flowbore and comprising one or more ports providing a route of fluid communication between the axial flowbore and an exterior of the housing, a sliding sleeve disposed within the housing and comprising a seat and an orifice, the sliding sleeve being movable from a first position to a second position, and a fluid delay system comprising a fluid chamber containing a fluid, transitioning the sliding sleeve from the first position in which the ports of the housing are obstructed by the sliding sleeve to the second position in which the ports of the housing are unobstructed by the sliding sleeve, wherein the fluid delay system causes the sliding sleeve to transition from the first position to the second position at a delayed rate, wherein the delayed rate of transition from the first position to the second position causes an elevation of pressure within casing string, verifying that the sliding sleeve has transitioned from the first position to the second position, and communicating a wellbore servicing fluid via the ports.

Further disclosed herein is a wellbore servicing method comprising activating a wellbore servicing apparatus by transitioning the wellbore servicing apparatus from a first mode to a second mode, wherein the wellbore servicing apparatus is configured to transition from the first mode to the second mode at a delayed rate and to cause an elevation of pressure within a flowbore of the wellbore servicing apparatus, and detecting the elevation of the pressure within the flowbore, wherein detection of the elevation of the pressure within the flowbore for a predetermined duration, to a predetermined magnitude, or both serves as an indication that the wellbore servicing apparatus is transitioning from the first mode to the second mode.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
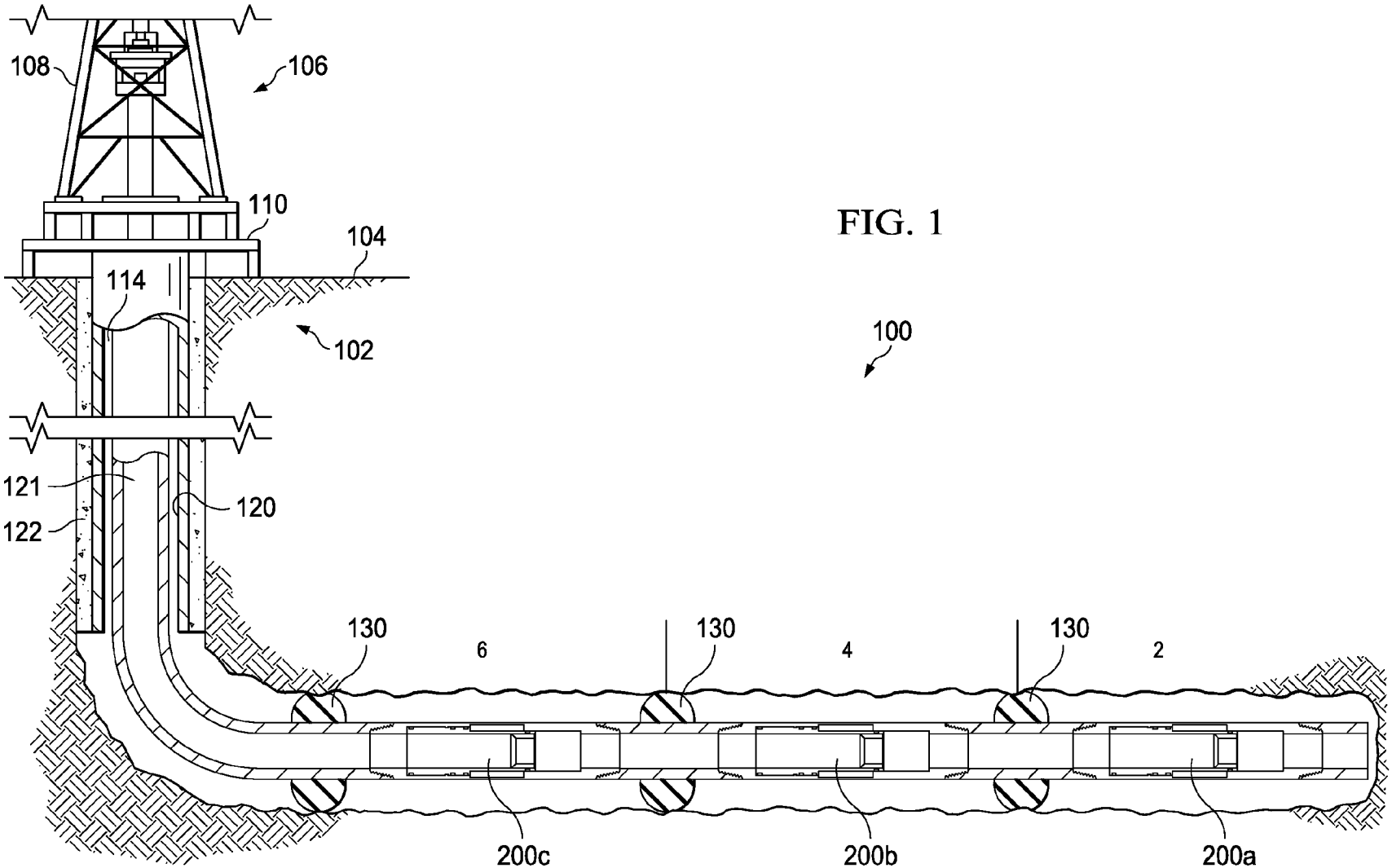
FIG. 1 is partial cut-away view of an embodiment of an environment in which at least one activation-indicating stimulation assembly (ASA) may be employed.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing apparatuses, systems, and methods of using the same. Particularly, disclosed herein are one or more embodiments of a wellbore servicing system comprising one or more activation-indicating stimulation assemblies (ASAs), configured for selective activation in the performance of a wellbore servicing operation. In an embodiment, an ASA, as will be disclosed herein, may be configured to indicate that it has been and/or is being activated by inducing variations in the pressure of a fluid being communicated to the ASA.

Referring to FIG. 1, an embodiment of an operating environment in which such a wellbore servicing apparatus and/or system may be employed is illustrated. It is noted that although some of the figures may exemplify horizontal or vertical wellbores, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

As depicted in FIG. 1, the operating environment generally comprises a wellbore 114 that penetrates a subterranean formation 102 comprising a plurality of formation zones 2, 4, and 6 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig comprises a derrick with a rig floor through which a work string (e.g., a drill string, a tool string, a segmented tubing string, a jointed tubing string, or any other suitable conveyance, or combinations thereof) generally defining an axial flowbore may be positioned within or partially within the wellbore 114. In an embodiment, such a work string may comprise two or more concentrically positioned strings of pipe or tubing (e.g., a first work string may be positioned within a second work string). The drilling or servicing rig may be conventional and may comprise a motor driven winch and other associated equipment for lowering the work string into the wellbore 114. Alternatively, a mobile workover rig, a wellbore servicing unit (e.g., coiled tubing units), or the like may be used to lower the work string into the wellbore 114. In such an embodiment, the work string may be utilized in drilling, stimulating, completing, or otherwise servicing the wellbore, or combinations thereof.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved and such wellbore may be cased, uncased, or combinations thereof.

In an embodiment, the wellbore 114 may be at least partially cased with a casing string 120 generally defining an axial flowbore 121. In an alternative embodiment, a wellbore like wellbore 114 may remain at least partially uncased. The casing string 120 may be secured into position within the wellbore 114 in a conventional manner with cement 122, alternatively, the casing string 120 may be partially cemented within the wellbore, or alternatively, the casing string may be uncemented. For example, in an alternative embodiment, a portion of the wellbore 114 may remain uncemented, but may employ one or more packers (e.g., Swellpackers™ commercially available from Halliburton Energy Services, Inc.) to isolate two or more adjacent portions or zones within the wellbore 114. In an embodiment, a casing string like casing string 120 may be positioned within a portion of the wellbore 114, for example, lowered into the wellbore 114 suspended from the work string. In such an embodiment, the casing string may be suspended from the work string by a liner hanger or the like. Such a liner hanger may comprise any suitable type or configuration of liner hanger, as will be appreciated by one of skill in the art with the aid of this disclosure.

Referring to FIG. 1, a wellbore servicing system 100 is illustrated. In the embodiment of FIG. 1, the wellbore servicing system 100 comprises a first, second, and third ASA, denoted 200*a*, 200*b*, and 200*c*, respectively, incorporated within the casing string 120 and each positioned proximate and/or substantially adjacent to one of subterranean formation zones (or "pay zones") 2, 4, or 6. Although the embodiment of FIG. 1 illustrates three ASAs (e.g., each being positioned substantially proximate or adjacent to one of three formation zones), one of skill in the art viewing this disclosure will appreciate that any suitable number of ASAs may be similarly incorporated within a casing such as casing string 120, for example, 2, 3, 4, 5, 6, 7, 8, 9, 10, etc. ASAs. Additionally, although the embodiment of FIG. 1 illustrates the wellbore servicing system 100 incorporated within casing string 120, a similar wellbore servicing system may be similarly incorporated within another casing string (e.g., a secondary casing string), or within any suitable work string (e.g., a drill string, a tool string, a segmented tubing string, a jointed tubing string, or any other suitable conveyance, or combinations thereof), as may be appropriate for a given servicing operation. Additionally, while in the embodiment of FIG. 1, a single ASA is located and/or positioned substantially adjacent to each zone (e.g., each of zones 2, 4, and 6); in alternative embodiments, two or more ASAs may be positioned proximate and/or substantially adjacent to a given zone, alternatively, a given single ASA may be positioned adjacent to two or more zones.

In the embodiment of FIG. 1, the wellbore servicing system 100 further comprises a plurality of wellbore isolation devices 130. In the embodiment of FIG. 1, the wellbore isolation devices 130 are positioned between adjacent ASAs 200*a*-200*c*, for example, so as to isolate the various formation zones 2, 4, and/or 6. Alternatively, two or more adjacent formation zones may remain unisolated. Suitable wellbore isolation devices are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof.

In one or more of the embodiments disclosed herein, one or more of the ASAs (cumulatively and non-specifically referred to as an ASA 200) may be configured to be activated while disposed within a wellbore like wellbore 114 and to indicate when such activation has occurred and/or is occurring. In an embodiment, an ASA 200 may be transitionable from a "first" mode or configuration to a "second" mode or configuration.

Figure 2A:
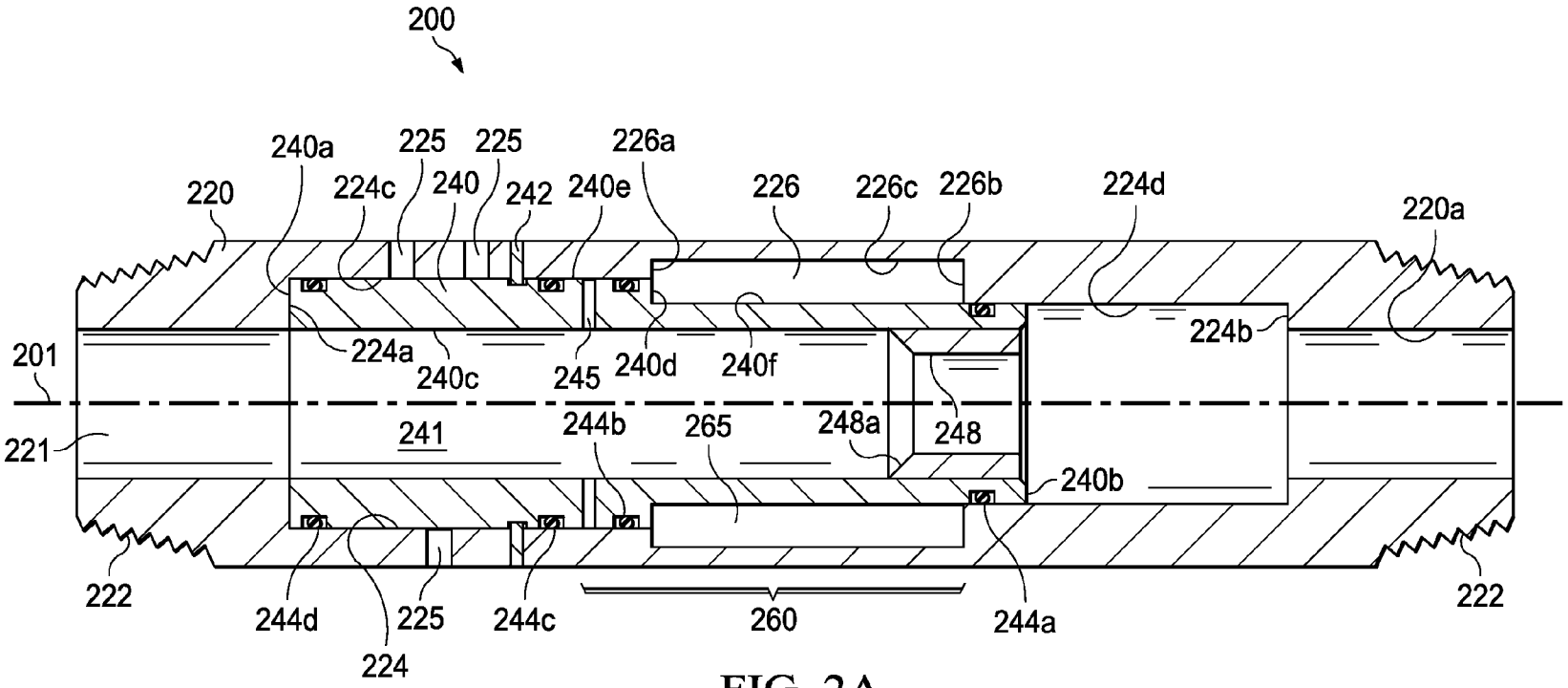
FIG. 2A is a cross-sectional view of an embodiment of an ASA in a first, installation configuration.

Referring to FIG. 2A, an embodiment of an ASA 200 is illustrated in the first mode or configuration. In an embodiment, when the ASA 200 is in the first mode or configuration, also referred to as a run-in or installation mode, the ASA 200 will not provide a route of fluid communication from the flowbore 121 of the casing string 120 to the proximate and/or substantially adjacent zone of the subterranean formation 102, as will be described herein.

Figure 2B:
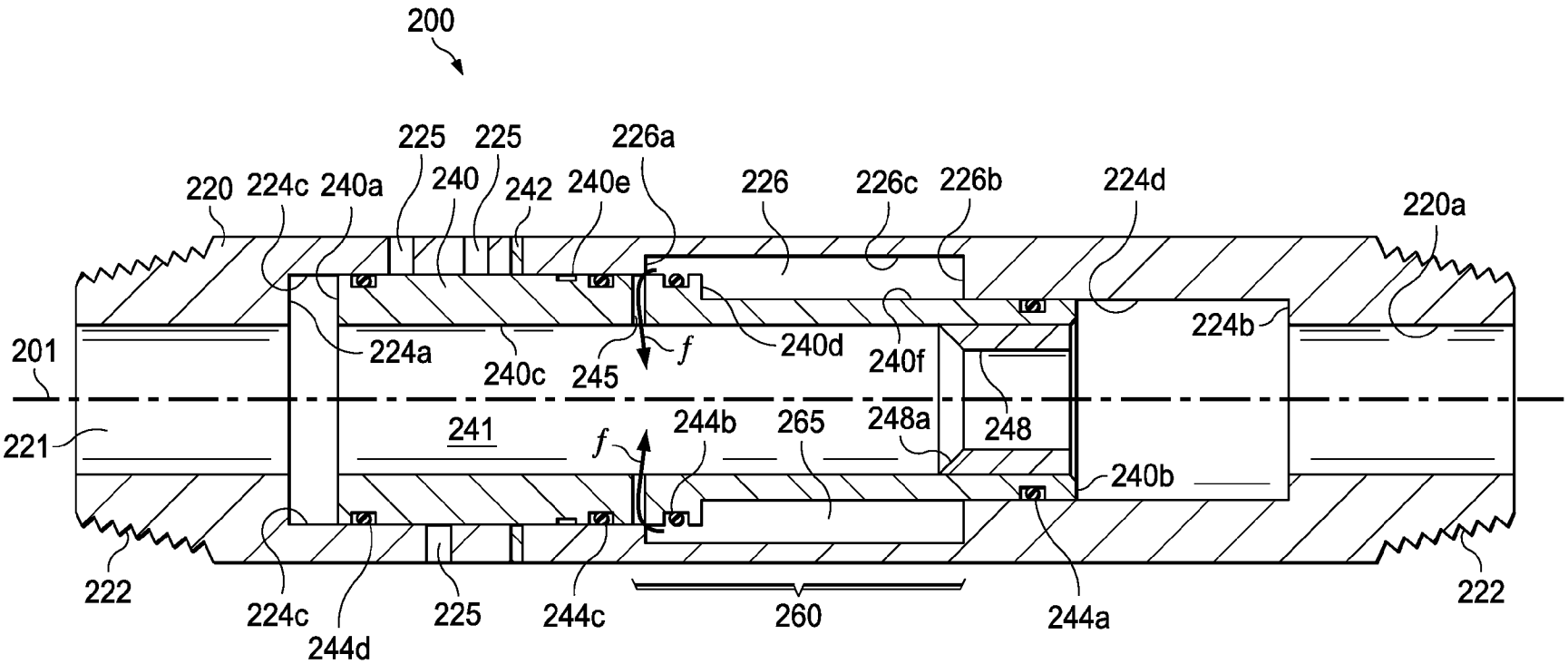
FIG. 2B is a cross-sectional view of an embodiment of the ASA of FIG. 1 in transition from the first, installation configuration to a second, activated configuration.

Referring to FIG. 2B, an embodiment of an ASA 200 is illustrated in transition from the first mode or configuration to a second mode or configuration. In an embodiment, as will be disclosed herein, the ASA may be configured to provide a delay in the transition of the ASA 200 from the first mode to the second and, as will be disclosed herein, to thereby provide a signal that the ASA 200 has transitioned and/or is transitioning from the first mode to the second mode.

Figure 2C:
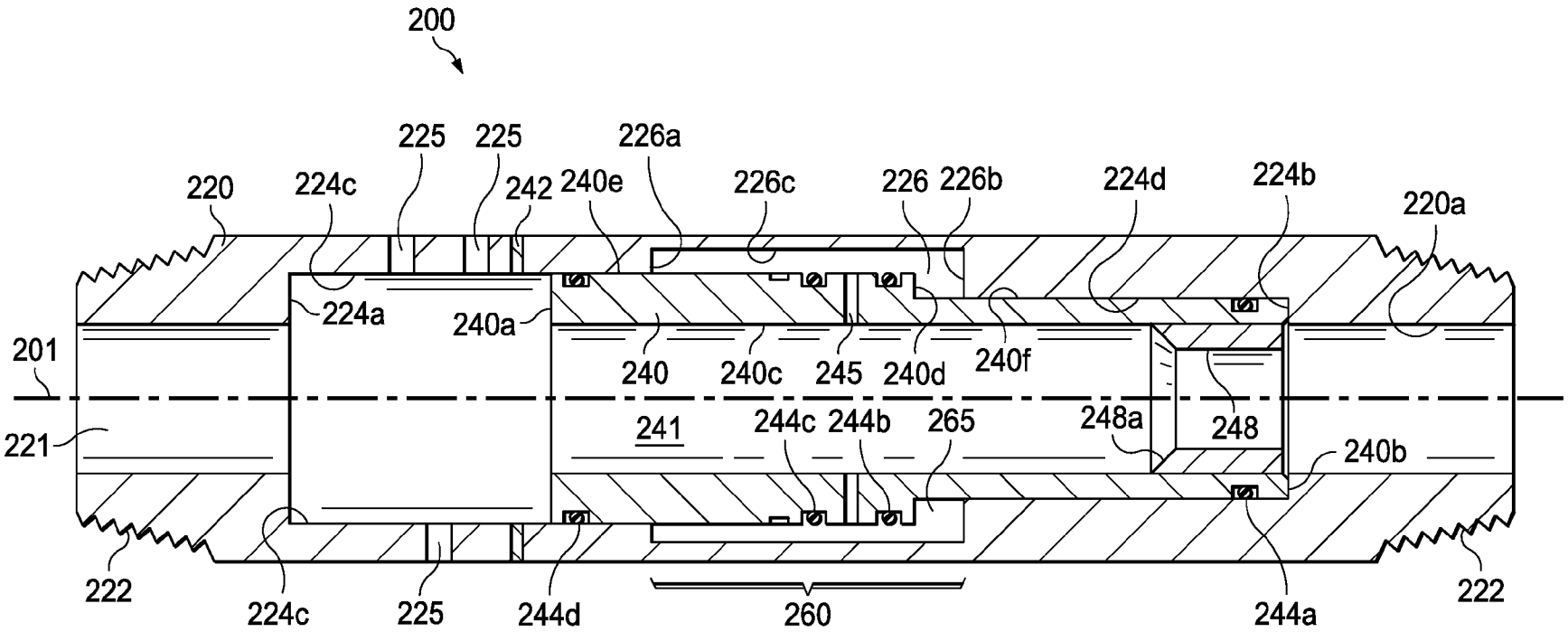
FIG. 2C is a cross-sectional view of an embodiment of the ASA of FIG. 1 in the second, activated configuration.

Referring to FIG. 2C, an embodiment of an ASA 200 is illustrated in the second mode or configuration. In an embodiment, when the ASA 200 is in the second mode or configuration, also referred to as an activated mode, the ASA will provide a route of fluid communication from the flowbore 121 of the casing 120 to the proximate and/or substantially adjacent zone of the subterranean formation 102, as will be described herein.

Referring to the embodiments of FIGS. 2A, 2B, and 2C, the ASA 200 generally comprises a housing 220, a sliding sleeve 240, and a delay system 260. The ASA 200 may be characterized as having a longitudinal axis 201.

In an embodiment, the housing 220 may be characterized as a generally tubular body generally defining a longitudinal, axial flowbore 221. In an embodiment, the housing may comprise an inner bore surface 220*a* generally defining the axial flowbore 221. In an embodiment, the housing 220 may be configured for connection to and/or incorporation within a string, such as the casing string 120 or, alternatively, a work string. For example, the housing 220 may comprise a suitable means of connection to the casing string 120 (e.g., to a casing member such as casing joint or the like). For example, in the embodiment of FIGS. 2A, 2B, and 2C, the terminal ends of the housing 220 comprise one or more internally and/or externally threaded surfaces 222, for example, as may be suitably employed in making a threaded connection to the casing string 120. Alternatively, an ASA like ASA 200 may be incorporated within a casing string (or other work string) like casing string 120 by any suitable connection, such as, for example, via one or more quick-connector type connections. Suitable connections to a casing member will be known to those of skill in the art viewing this disclosure. The axial flowbore 221 may be in fluid communication with the axial flowbore 121 defined by the casing string 120. For example, a fluid communicated via the axial flowbores 121 of the casing will flow into and via the axial flowbore 221.

In an embodiment, the housing 220 may comprise one or more ports 225 suitable for the communication of fluid from the axial flowbore 221 of the housing 220 to a proximate subterranean formation zone when the ASA 200 is so-configured. For example, in the embodiment of FIGS. 2A and 2B, the ports 225 within the housing 220 are obstructed, as will be discussed herein, and will not communicate fluid from the axial flowbore 221 to the surrounding formation. In the embodiment of FIG. 2C, the ports 225 within the housing 220 are unobstructed, as will be discussed herein, and may communicate fluid from the axial flowbore 221 to the surrounding formation 102. In an embodiment, the ports 225 may be fitted with one or more pressure-altering devices (e.g., nozzles, erodible nozzles, or the like). In an additional embodiment, the ports 225 may be fitted with plugs, screens, covers, or shields, for example, to prevent debris from entering the ports 225.

In an embodiment, the housing 220 may comprise a unitary structure (e.g., a continuous length of pipe or tubing); alternatively, the housing 220 may comprise two or more operably connected components (e.g., two or more coupled sub-components, such as by a threaded connection). Alternatively, a housing like housing 220 may comprise any suitable structure; such suitable structures will be appreciated by those of skill in the art upon viewing this disclosure.

In an embodiment, the housing 220 may comprise a recessed, sliding sleeve bore 224. For example, in the embodiments of FIGS. 2A, 2B, and 2C, the sleeve bore 224 may generally comprise a passageway (e.g., a circumferential recess extending a length parallel to the longitudinal axis 201) in which the sliding sleeve 240 may move longitudinally, axially, radially, or combinations thereof within the axial flowbore 221. In an embodiment, the sliding sleeve bore 224 may extend circumferentially from the housing 220 (e.g., at a depth beneath that of the inner bore surface 220*a*). For example, in the embodiment of FIGS. 2A, 2B, and 2C, the sliding sleeve bore 224 comprises a diameter greater than the diameter of the inner surface of the housing 220*a*. In the embodiments of FIGS. 2A, 2B, and 2C, the sliding sleeve bore 224 is generally defined by an upper shoulder 224*a*, a lower shoulder 224*b*, a first recessed bore surface 224*c* extending from the upper shoulder 224*a* in the direction of the lower shoulder 224*b*, and a second recessed bore surface 224*d* extending from the lower shoulder 224*b* in the direction of the upper shoulder 224*a*. In an embodiment, the first recessed bore surface 224*c* may have a diameter greater than the diameter of the second recessed bore surface 224*d*. In an embodiment, the sliding sleeve bore 224 may comprise one or more grooves, guides, or the like (e.g., longitudinal grooves), for example, to align and/or orient the sliding sleeve 240 via a complementary structure (e.g., one or more lugs, pegs, grooves, or the like) on the second sliding sleeve 240.

In an embodiment, the housing 220 may further comprise a recessed bore in which the delay system 260 may be at least partially disposed, that is, a delay system recess 226. In an embodiment, the delay system recess 226 may generally comprise a circumferential recess extending a length along the longitudinal axis and may extend circumferentially from the surfaces of the sliding sleeve bore 224 (e.g., to a depth beneath that of the first and second recessed bore surfaces 224*c* and 224*d*). For example, in the embodiment of FIGS. 2A, 2B, and 2C, the delay system recess comprises a diameter greater than the diameter of the first and/or second recessed bore surfaces, 224*c* and 224*d*, respectively. In an embodiment, for example, as illustrated in the embodiments of FIGS. 2A, 2B, and 2C, the delay system recess 226 may be longitudinally spaced within the sleeve bore 224. In the embodiment of FIGS. 2A, 2B, and 2C, the delay system recess 226 is generally defined by an upper shoulder 226*a*, a lower shoulder 226*b*, and a recessed bore surface 226*c* extending between the upper shoulder 226*a* and the lower shoulder 226*b*.

In an embodiment, the sliding sleeve 240 generally comprises a cylindrical or tubular structure. In an embodiment, the sliding sleeve 240 generally comprises an upper orthogonal face 240*a*, a lower orthogonal face 240*b*, an inner cylindrical surface 240*c* at least partially defining an axial flowbore 241 extending therethrough, a downward-facing shoulder 240*d*, a first outer cylindrical surface 240*e* extending between the upper orthogonal face 240*a* and the shoulder 240*d*, and a second outer cylindrical surface 240*f* extending between the shoulder 240*d* and the lower orthogonal face 240*b*. In an embodiment, the diameter of the first outer cylindrical surface 240*e* may be greater than the diameter of the second outer cylindrical surface 240*f*. In an embodiment, the axial flowbore 241 defined by the sliding sleeve 240 may be coaxial with and in fluid communication with the axial flowbore 221 defined by the housing 220. In the embodiment of FIGS. 2A, 2B, and 2C, the sliding sleeve 240 may comprise a single component piece. In an alternative embodiment, a sliding sleeve like the sliding sleeve 240 may comprise two or more operably connected or coupled component pieces.

In an embodiment, the sliding sleeve 240 may be slidably and concentrically positioned within the housing 220. As illustrated in the embodiment of FIGS. 2A, 2B, and 2C, the sliding sleeve 240 may be positioned within the axial flowbore 221 of the housing 220. For example, in the embodiment of FIGS. 2A, 2B, and 2C, at least a portion of the first outer cylindrical surface 240*e* of the sliding sleeve 240 may be slidably fitted against at least a portion of the first recessed bore surface 224*c* of the sliding sleeve bore 224 and/or at least a portion of the second outer cylindrical surface 240*f* of the sliding sleeve 240 may be slidably fitted against at least a portion of the second recessed bore surface 224*d* of the sliding sleeve bore 224.

In an embodiment, the sliding sleeve 240, the housing 220, or both may comprise one or more seals at the interface between the first outer cylindrical surface 240*e* of the sliding sleeve 240 and the first recessed bore surface 224*c* of the sliding sleeve bore 224 and/or between the second outer cylindrical surface 240*f* of the sliding sleeve 240 and the second recessed bore surface 224*d* of the sliding sleeve bore 224. For example, in an embodiment, the first sliding sleeve 240 may further comprise one or more radial or concentric recesses or grooves configured to receive one or more suitable fluid seals, for example, to restrict fluid movement via the interface between the first outer cylindrical surface 240*e* of the sliding sleeve 240 and the first recessed bore surface 224*c* of the sliding sleeve bore 224 and/or between the second outer cylindrical surface 240*f* of the sliding sleeve 240 and the second recessed bore surface 224*d* of the sliding sleeve bore 224. Suitable seals include but are not limited to a T-seal, an O-ring, a gasket, or combinations thereof. For example, in the embodiments of FIGS. 2A, 2B, and 2C, the sliding sleeve 240 comprises a first seal 244*a* at the interface between the first outer cylindrical surface 240*e* of the sliding sleeve 240 and the first recessed bore surface 224*c* of the sliding sleeve bore 224, and a second, a third, and a fourth seal, 244*b*, 244*c*, and 244*d*, respectively, at the interface between the second outer cylindrical surface 240*f* of the sliding sleeve 240 and the second recessed bore surface 224*d* of the sliding sleeve bore 224.

In an embodiment, the sliding sleeve 240 may be slidably movable from a first position to a second position within the housing 220. Referring again to FIG. 2A, the sliding sleeve 240 is shown in the first position. In the embodiment illustrated in FIG. 2A, when the sliding sleeve 240 is in the first position, the sliding sleeve 240 obstructs the ports 225 of the housing 220, for example, such that fluid will not be communicated between the axial flowbore 221 of the housing 220 and the exterior of the housing (e.g., to proximate and/or substantially adjacent zone of the subterranean formation 102) via the ports 225. In an embodiment, in the first position, the sliding sleeve 240 may be characterized as in a relatively up-hole position within the housing 220 (that is, relative to the second position and to the left as illustrated). For example, as illustrated in FIG. 2A, in the first position the upper orthogonal face 240*a* of the sliding sleeve 240 may abut the upper shoulder 224*a* of the sliding sleeve bore 224. In an embodiment, the sliding sleeve 240 may be held in the first position by suitable retaining mechanism. For example, in the embodiment of FIG. 2A, the sliding sleeve 240 is retained in the first position by one or more frangible members, such as shear-pins 242 or the like. The shear pins may be received by a shear-pin bore within the sliding sleeve 240 and shear-pin bore in the housing 220. In an embodiment, when the sliding sleeve 240 is in the first position, the ASA 200 is configured in the first mode or configuration (e.g., a run-in or installation mode).

Referring to FIG. 2C, the sliding sleeve 240 is shown in the second position. In the embodiment illustrated in FIG. 2C, when the sliding sleeve 240 is in the second position, the sliding sleeve 240 does not obstruct the ports 225 of the housing 220, for example, such fluid may be communicated between the axial flowbore 221 of the housing 220 and the exterior of the housing (e.g., to the proximate and/or substantially adjacent zone of the subterranean formation 102) via the ports 225. In an embodiment, in the second position, the sliding sleeve 240 may be characterized as in a relatively down-hole position within the housing 220 (that is, relative to the first position and to the right as illustrated). For example, as illustrated in FIG. 2C, in the second position the lower orthogonal face 240*b* of the sliding sleeve may abut the lower shoulder 224*b* of the sliding sleeve bore 224. In an embodiment, the sliding sleeve 240 may be held in the second position by a suitable retaining mechanism. For example, in an embodiment the sliding sleeve 240 may be retained in the second position by a snap-ring, a snap-pin, or the like. For example, such a snap-ring may be received and/or carried within snap-ring groove within the first sliding sleeve 240 and may expand into a complementary groove within the housing 220 when the sliding sleeve 240 is in the second position and, thereby, retain the first sliding sleeve 240 in the second position. Alternatively, the sliding sleeve may be retained in the second position by the application of pressure (e.g., fluid pressure) to the axial flowbore 221 (e.g., due to a differential between the upward and downward forces applied to the sliding sleeve 240 by such a fluid pressure).

In an alternative embodiment, a first sliding sleeve like first sliding sleeve 240 may comprise one or more ports suitable for the communication of fluid from the axial flowbore 221 of the housing 220 and/or the axial flowbore 241 of the first sliding sleeve 240 to a proximate subterranean formation zone when the master ASA 200 is so-configured. For example, in an embodiment where such a first sliding sleeve is in the first position, as disclosed herein above, the ports within the first sliding sleeve 240 will be misaligned with the ports 225 of the housing and will not communicate fluid from the axial flowbore 221 and/or axial flowbore 241 to the wellbore and/or surrounding formation. When such a first sliding sleeve is in the second position, as disclosed herein above, the ports within the first sliding sleeve will be aligned with the ports 225 of the housing and will communicate fluid from the axial flowbore 221 and/or axial flowbore 241 to the wellbore and/or surrounding formation.

In an embodiment, the first sliding sleeve 240 may be configured to be selectively transitioned from the first position to the second position. For example, in the embodiment of FIGS. 2A-2C, the first sliding sleeve 240 comprises a seat 248 configured to receive, engage, and/or retain an obturating member (e.g., a ball or dart) of a given size and/or configuration moving via axial flowbores 221 and 241. For example, in an embodiment the seat 248 comprises a reduced flowbore diameter in comparison to the diameter of axial flowbores 221 and/or 241 and a bevel or chamfer 248*a* at the reduction in flowbore diameter, for example, to engage and retain such an obturating member. In such an embodiment, the seat 248 may be configured such that, when the seat 248 engages and retains such an obturating member, fluid movement via the axial flowbores 221 and/or 241 may be impeded, thereby causing hydraulic pressure to be applied to the first sliding sleeve 240 so as to move the first sliding sleeve 240 from the first position to the second position. As will be appreciated by one of skill in the art viewing this disclosure, a seat, such as seat 248, may be sized and/or otherwise configured to engage and retain an obturating member (e.g., a ball, a dart, or the like) or a given size or configuration. In an embodiment, the seat 248 may be integral with (e.g., joined as a single unitary structure and/or formed as a single piece) and/or connected to the first sliding sleeve 240. For example, in embodiment, the expandable seat 248 may be attached to the first sliding sleeve 240. In an alternative embodiment, a seat may comprise an independent and/or separate component from the first sliding sleeve but nonetheless capable of applying a pressure to the first sliding sleeve to transition the first sliding sleeve from the first position to the second position. For example, such a seat may loosely rest against and/or adjacent to the first sliding sleeve.

In an alternative embodiment, a first sliding sleeve like first sliding sleeve 240 may be configured such that the application of a fluid and/or hydraulic pressure (e.g., a hydraulic pressure exceeding a threshold) to the axial flowbore thereof will cause such the first sliding sleeve to transition from the first position to the second position. For example, in such an embodiment, the first sliding sleeve may be configured such that the application of fluid pressure to the axial flowbore results in a net hydraulic force applied to the first sliding sleeve in the direction of the second position. For example, the hydraulic forces applied to the first sliding sleeve may be greater in the direction that would move the first sliding sleeve toward the second position than the hydraulic forces applied in the direction that would move the first sliding sleeve away from the second position, as may result from a differential in the surface area of the downward-facing and upward-facing surfaces of the first sliding sleeve. One of skill in the art, upon viewing this disclosure, will appreciate that a first sliding sleeve may be configured for movement upon the application of a sufficient hydraulic pressure.

In an embodiment, the delay system 260 generally comprises one or more suitable devices, structures, assemblages configured to delay the movement of the sliding sleeve 240 from the first position to the second position, for example, such that at least a portion of the movement of the sliding sleeve 240 from the first position to the second position occurs at a controlled rate.

In the embodiment of FIGS. 2A, 2B, and 2C, the delay system 260 comprises a fluid delay system. In such an embodiment, the fluid delay system generally comprises a fluid chamber 265 having a volume that varies dependent upon the position of the sliding sleeve 240 in relation to the housing 220, a fluid disposed within the fluid chamber, and a meter or other means of allowing the fluid within the chamber to escape and/or dissipate therefrom at a controlled rate.

In an embodiment, the fluid chamber 265 may be cooperatively defined by the housing 220 and the sliding sleeve 240. For example, in the embodiment of FIGS. 2A, 2B, and 2C, the fluid chamber 265 is substantially defined by the upper shoulder 226*a*, the lower shoulder 226*b*, and the recessed bore surface 226*c* of the delay system recess 226 and the shoulder 240*d*, the second outer cylindrical surface 240*f*, and, depending upon the configuration of the ASA 200, the first outer cylindrical surface 240*e* of the sliding sleeve 240.

In an embodiment, the fluid chamber 265 may be characterized as having a variable volume, dependent upon the position of the sliding sleeve 240 relative to the housing 220. For example, when the sliding sleeve 240 is in the first position, the volume of the fluid reservoir 265 may be a maximum and, when the sliding sleeve 240 is in the second position, the volume of the fluid reservoir may be relatively less (e.g., a minimum). For example, in the embodiment of FIG. 2A, where the sliding sleeve 240 is in the first position, the shoulder 240*d* of the sliding sleeve 240 is a predetermined (e.g., an increased or maximum) distance from the lower shoulder 226*b* of the delay system recess 226, thereby increasing the volume of the fluid chamber 265. Also, in the embodiment of FIG. 2C, where the sliding sleeve is in the second position, the shoulder 240*d* of the sliding sleeve 240 is a predetermined (e.g., a decreased or minimum) distance from the lower shoulder 226*b* of the delay system recess 226, thereby decreasing the volume of the fluid chamber 265.

In an embodiment, the fluid chamber 265 may be filled, substantially filled, or partially filled with a suitable fluid. In an embodiment, the fluid may be characterized as having a suitable rheology. In an embodiment, for example, in an embodiment where the fluid chamber 265 is filled or substantially filled with the fluid, the fluid may be characterized as a compressible fluid, for example a fluid having a relatively low compressibility. In an alternative embodiment, for example, in an embodiment where the fluid chamber 265 is incompletely or partially filled with the by the fluid, the fluid may be characterized as substantially incompressible. In an embodiment, the fluid may be characterized as having a suitable bulk modulus, for example, a relatively high bulk modulus. For example, in an embodiment, the fluid may be characterized as having a bulk modulus in the range of from about 1.8 $10^5$ psi, $lb_f/in^2$ to about 2.8 $10^5$ psi, $lb_f/in^2$ from about 1.9 $10^5$ psi, $lb_f/in^2$ to about 2.6 $10^5$ psi, $lb_f/in^2$, alternatively, from about 2.0 $10^5$ psi, $lb_f/in^2$ to about 2.4 $10^5$ psi, $lb_f/in^2$. In an additional embodiment, the fluid may be characterized as having a relatively low coefficient of thermal expansion. For example, in an embodiment, the fluid may be characterized as having a coefficient of thermal expansion in the range of from about 0.0004 cc/cc/° C. to about 0.0015 cc/cc/° C., alternatively, from about 0.0006 cc/cc/° C. to about 0.0013 cc/cc/° C., alternatively, from about 0.0007 cc/cc/° C. to about 0.0011 cc/cc/° C. In another additional embodiment, the fluid may be characterized as having a stable fluid viscosity across a relatively wide temperature range (e.g., a working range), for example, across a temperature range from about 50° F. to about 400° F., alternatively, from about 60° F. to about 350° F., alternatively, from about 70° F. to about 300° F. In another embodiment, the fluid may be characterized as having a viscosity in the range of from about 50 centistokes to about 500 centistokes. Examples of a suitable fluid include, but are not limited to oils, such as synthetic fluids, hydrocarbons, or combinations thereof. Particular examples of a suitable fluid include silicon oil, paraffin oil, petroleum-based oils, brake fluid (glycol-ether-based fluids, mineral-based oils, and/or silicon-based fluids), transmission fluid, synthetic fluids, or combinations thereof.

In an embodiment, the meter or means for allowing escape and/or dissipation of the fluid from the fluid chamber may comprise an orifice. For example, in the embodiment of FIGS. 2A, 2B, and 2C, the first sliding sleeve 240 comprises orifice 245. In various embodiments, the orifice 245 may be sized and/or otherwise configured to communicate a fluid of a given character at a given rate. In an embodiment, a plurality of orifices life orifice 245 may be used (e.g., two orifices, as illustrated in the embodiments of FIGS. 2A, 2B, and 2C). As may be appreciated by one of skill in the art, the rate at which a fluid is communicated via the orifice 245 may be at least partially dependent upon the viscosity of the fluid, the temperature of the fluid, the pressure of the fluid, the presence or absence of particulate material in the fluid, the flow-rate of the fluid, or combinations thereof and/or, the pack-off the opening over time, thereby restricting flow therethrough.

In an embodiment, the orifice 245 may be formed by any suitable process or apparatus. For example, the orifice 245 may be cut into the first sliding sleeve 240 with a laser, a bit, or any suitable apparatus in order to achieve a precise size and/or configuration. In an embodiment, an orifice like orifice 245 may be fitted with nozzles or fluid metering devices, for example, such that the flow rate at which the fluid is communicated via the orifice is controlled at a predetermined rate. Additionally, an orifice like orifice 245 may be fitted with erodible fittings, for example, such that the flow rate at which fluid is communicated via the orifice varies over time. Also, in an embodiment, an orifice like orifice 245 may be fitted with screens of a given size, for example, to restrict particulate flow through the orifice.

In an additional or alternative embodiment, the orifice 245 may further comprise a fluid metering device received at least partially therein. In such an embodiment, the fluid metering device may comprise a fluid restrictor, for example a precision microhydraulics fluid restrictor or micro-dispensing valve of the type produced by The Lee Company of Westbrook, Conn. However, it will be appreciated that in alternative embodiments any other suitable fluid metering device may be used. For example, any suitable electro-fluid device may be used to selectively pump and/or restrict passage of fluid through the device. In further alternative embodiments, a fluid metering device may be selectively controlled by an operator and/or computer so that passage of fluid through the metering device may be started, stopped, and/or a rate of fluid flow through the device may be changed. Such controllable fluid metering devices may be, for example, substantially similar to the fluid restrictors produced by The Lee Company.

Referring to FIG. 2A, when the sliding sleeve 240 is in the first position, the orifice 245 is not in fluid communication with the fluid chamber 265, for example, such that the fluid is retained within the fluid chamber 265. Referring to FIGS. 2B and 2C, when the sliding sleeve 240 has moved from the first position in the direction of the second position, the orifice 245 comes into fluid communication with the fluid chamber 265, for example, such that the fluid may escape from the fluid chamber 265 via the orifice, as will be disclosed herein.

In an alternative embodiment, the delay system may comprise an alternative means of controlling the movement of the sliding sleeve 240 from the first position to the second position. A suitable alternative delay system may include, but is not limited to, a friction rings, (e.g., configured to cause friction between the sliding sleeve and the housing), a crushable or frangible member, or the like, as may be appreciated by one of skill in the art upon viewing this disclosure.

One or more embodiments of an ASA 200 and a wellbore servicing system 100 comprising one or more ASAs 200 (e.g., ASAs 200*a*-200*c*) having been disclosed, one or more embodiments of a wellbore servicing method employing such a wellbore servicing system 100 and/or such an ASA 200 are also disclosed herein. In an embodiment, a wellbore servicing method may generally comprise the steps of positioning a wellbore servicing system comprising one or more ASAs within a wellbore such that each of the ASAs is proximate to a zone of a subterranean formation, optionally, isolating adjacent zones of the subterranean formation, transitioning the sliding sleeve within an ASA from its first position to its second position, detecting the configuration of the first ASA, and communicating a servicing fluid to the zone proximate to the ASA via the ASA.

In an embodiment, the process of transitioning a sliding sleeve within an ASA from its first position to its second position, detecting the configuration of that ASA, and communicating a servicing fluid to the zone proximate to the ASA via that ASA, as will be disclosed herein, may be repeated, for as many ASAs as may be incorporated within the wellbore servicing system.

In an embodiment, one or more ASAs may be incorporated within a work string or casing string, for example, like casing string 120, and may be positioned within a wellbore like wellbore 114. For example, in the embodiment of FIG. 1, the casing string 120 has incorporated therein the first ASA 200*a*, the second ASA 200*b*, and the third ASA 200*c*. Also in the embodiment of FIG. 1, the casing string 120 is positioned within the wellbore 114 such that the first ASA 200*a* is proximate and/or substantially adjacent to the first subterranean formation zone 2, the second ASA 200*b* is proximate and/or substantially adjacent to the second zone 4, and the third ASA 200*c* is proximate and/or substantially adjacent to the third zone 6. Alternatively, any suitable number of ASAs may be incorporated within a casing string. In an embodiment, the ASAs (e.g., ASAs 200*a*-200*c*) may be positioned within the wellbore 114 in a configuration in which no ASA will communicate fluid to the subterranean formation, particularly, the ASAs may be positioned within the wellbore 114 in the first, run-in, or installation mode or configuration.

In an embodiment where the ASAs (e.g., ASAs 200*a*-200*c*) incorporated within the casing string 120 are configured for activation by an obturating member engaging a seat within each ASA, as disclosed herein, the ASAs may be configured such that progressively more uphole ASAs are configured to engage progressively larger obturating members and to allow the passage of smaller obturating members. For example, in the embodiment of FIG. 1, the first ASA 200*a* may be configured to engage a first-sized obturating member, while such obturating member will pass through the second and third ASAs, 200*b* and 200*c*, respectively. The second ASA 200*b* may be configured to engage a second-sized obturating member, while such obturating member will pass through the third ASA 200*c*, and the third ASA 200*c* may be configured to engage a third-sized obturating member.

In an embodiment, once the casing string 120 comprising the ASAs (e.g., ASAs 200*a*-200*c*) has been positioned within the wellbore 114, adjacent zones may be isolated and/or the casing string 120 may be secured within the formation. For example, in the embodiment of FIG. 1, the first zone 2 may be isolated from the second zone 4, the second zone 4 from the third zone 6, or combinations thereof. In the embodiment of FIG. 1, the adjacent zones (2, 4, and/or 6) are separated by one or more suitable wellbore isolation devices 130. Suitable wellbore isolation devices 130 are generally known to those of skill in the art and include but are not limited to packers, such as mechanical packers and swellable packers (e.g., Swellpackers™, commercially available from Halliburton Energy Services, Inc.), sand plugs, sealant compositions such as cement, or combinations thereof. In an alternative embodiment, only a portion of the zones (e.g., 2, 4, and/or 6) may be isolated, alternatively, the zones may remain unisolated. Additionally and/or alternatively, the casing string 120 may be secured within the formation, as noted above, for example, by cementing.

In an embodiment, the zones of the subterranean formation (e.g., 2, 4, and/or 6) may be serviced working from the zone that is furthest down-hole (e.g., in the embodiment of FIG. 1, the first formation zone 2) progressively upward toward the furthest up-hole zone (e.g., in the embodiment of FIG. 1, the third formation zone 6). In alternative embodiments, the zones of the subterranean formation may be serviced in any suitable order. As will be appreciated by one of skill in the art, upon viewing this disclosure, the order in which the zones are serviced may be dependent upon, or at least influenced by, the method of activation chosen for each of the ASAs associated with each of these zones.

In an embodiment where the wellbore is serviced working from the furthest down-hole progressively upward, once the casing string comprising the ASAs has been positioned within the wellbore and, optionally, once adjacent zones of the subterranean formation (e.g., 2, 4, and/or 6) have been isolated, the first ASA 200*a* may be prepared for the communication of a fluid to the proximate and/or adjacent zone. In such an embodiment, the sliding sleeve 240 within the ASA (e.g., ASA 200*a*) proximate and/or substantially adjacent to the first zone to be serviced (e.g., formation zone 2), is transitioned from its first position to its second position. In an embodiment wherein the ASA is activated by an obturating member engaging a seat within the ASA, transitioning the sliding sleeve 240 within the ASA 200 to its second position may comprise introducing an obturating member (e.g., a ball or dart) configured to engage the seat 248 of that ASA 200 (e.g., ASA 200*a*) into the casing string 120 and forward-circulating (e.g., pumping) the obturating member to engage the seat 248.

In such an embodiment, when the obturating member has engaged the seat 248, continued application of a fluid pressure to the flowbore 221, for example, by continuing to pump fluid, may increase the force applied to the seat 248 and the first sliding sleeve 240 via the obturating member. Referring to FIG. 2B, application of sufficient force to the first sliding sleeve 240 via the seat 248 may cause the shear-pin 242 to shear, sever, or break, and the fluid within the fluid chamber 265 to be compressed. As the fluid becomes compressed, the first sliding sleeve 240 slidably moves from the first position (e.g., as shown in FIG. 2A) toward the second position (e.g., from left to right as shown in FIGS. 2B, and 2C). As the sliding sleeve 240 continues to move toward the second position, thereby compressing the fluid within the fluid chamber 265, the orifice 245 within the sliding sleeve 240 may come into fluid communication with the fluid chamber 265, thereby allowing the fluid within the fluid chamber 265 to escape and/or be dissipated therefrom (e.g., as illustrated by flow arrow f of FIG. 2B). For example, the orifice 245 may come into fluid communication with the fluid chamber 265 when the second seal 244 and/or when the orifice 245 reaches the upper shoulder 226*a* defining the fluid chamber 265. As fluid escapes and/or is dissipated from the fluid chamber 265, the sliding sleeve 240 is allowed to continue to move toward the second position. As such, the rate at which the sliding sleeve 240 may move from the first position to the second position is dependent upon the rate at which fluid is allowed to escape and/or dissipate from the fluid chamber 265 via orifice 245.

In an embodiment, the ASA 200 may be configured to allow the fluid to escape and/or dissipate from the fluid chamber 265 at a controlled rate over the entire length of the stroke (e.g., movement from the first position to the second position) of the sliding sleeve 240 or some portion thereof. For example, referring to the embodiments of FIGS. 2A, 2B, and 2C, the ASA 200 is configured to control the rate of movement of the sliding sleeve 240 over a first portion of the stroke and the allow the sliding sleeve 240 to move at a greater rate over a second portion of the stroke. For example, in the embodiment of FIGS. 2A, 2B, and 2C, when the third seal 244*c* reaches the upper shoulder 226*a* of the delay recess 226, fluid may be allowed to escape from the fluid chamber 265 at a much greater rate, for example, because the fluid may be allowed to escape and/or dissipate via the interface between the first outer cylindrical surface 240*e* of the sliding sleeve 240 and the first recessed bore surface 224*c* (e.g., and through the ports 225). Additionally or alternatively, in an embodiment additional orifices positioned within the sliding sleeve longitudinally between the first and second seals, 244*a* and 244*b*, may also be employed to control the rate at which fluid is dissipated.

In an embodiment, as the first sliding sleeve 240 moves from the first position to the second position, the first sliding sleeve 240 ceases to obscure the ports 225 within the housing 220.

In an embodiment, the ASA 200 may be configured such that the sliding sleeve 240 will transition from the first position to the second position at a rate such that the obstruction of the axial flowbore creates an increase in pressure (e.g., the fluid pressure within the axial flowbore 121 of the casing string 120) that is detectable by an operator (e.g., a pressure spike). For example, because the obturating member obstructs the movement of fluid via the axial flowbore 221 and because the ports remain obstructed (and, therefore, unable to communicate fluid) during the time (e.g., the delay or transition time) while the sliding sleeve 240 transitions from the first position to the second position, the pressure within the axial flowbore 221 of the ASA 200, and therefore, the pressure within the flowbore 121 of the casing string 120 may increase and/or remain at elevated pressure until the ports 225 begin to open, at which point the pressure make begin to decrease. Upon the sliding sleeve 240 reaching the second position, the ports 225 are unobstructed and the pressure may be allowed dissipate.

In such an embodiment, an operator may recognize that such a "pressure spike" may indicate the engagement of an obturating member by the seat of an ASA. In addition, the operator may recognize that such a "pressure spike," followed by a dissipation of the pressure may indicate the engagement of an obturating member by the seat of an ASA and the subsequent transitioning of the sliding sleeve of that ASA from the first position to the second position, thereby indicating that the obturating member has been engaged by the seat (e.g., landed on the seat) and that the ASA is configured for the communication of a servicing fluid to the formation or a zone thereof. As will be appreciated by one of skill in the art with the aid of this disclosure, such a "pressure spike" may be detectable by an operator, for example, at the surface. As will also be appreciated by one of skill in the art, the magnitude and/or duration (e.g., time of pressure spike, which may be about equal to an expected or designed delay or transition time) of such a "pressure spike" may be at least partially dependent upon the configuration of the ASA, for example, the volume of the fluid chamber, the rate at which fluid is allowed to escape and/or dissipate from the chamber, the length of the stroke of the sliding sleeve, or combinations of these and other like variables.

For example, an ASA may be configured to provide a pressure increase, as observed at the surface, of at least 300 psi, alternatively at least 400 psi, alternatively, in the range of from about 500 psi to about 3000 psi. Also, for example, an ASA may be configured to provide a pressure increase, as observed at the surface, for a duration of at least 0.1 seconds, alternatively, in the range of from about 1 second to about 30 seconds, alternatively, from about 2 seconds to about 10 seconds. In an additional embodiment, the duration of any such deviation in the observed pressure may be monitored and/or analyzed with reference to a predetermined or expected design value (e.g., for comparison to threshold value).

In an embodiment, when the operator has confirmed that the first ASA 200*a* is configured for the communication of a servicing fluid, for example, by detection of a "pressure spike" as disclosed herein, a suitable wellbore servicing fluid may be communicated to the first subterranean formation zone 2 via the ports 225 of the first ASA 200*a*. Nonlimiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure for a suitable duration. For example, the wellbore servicing fluid may be communicated at a rate and/or pressure sufficient to initiate or extend a fluid pathway (e.g., a perforation or fracture) within the subterranean formation 102 and/or a zone thereof.

In an embodiment, when a desired amount of the servicing fluid has been communicated to the first formation zone 2, an operator may cease the communication of fluid to the first formation zone 2. Optionally, the treated zone may be isolated, for example, via a mechanical plug, sand plug, or the like, placed within the flowbore between two zones (e.g., between the first and second zones, 2 and 4). The process of transitioning a sliding sleeve within an ASA from its first position to its second position, detecting the configuration of that ASA, and communicating a servicing fluid to the zone proximate to the ASA via that ASA may be repeated with respect the second and third ASAs, 200*b* and 200*c*, respectively, and formation zones 4 and 6, associated therewith. Additionally, in an embodiment where additional zones are present, the process may be repeated for any one or more of the additional zones and the associated ASAs.

In an embodiment, an ASA such as ASA 200, a wellbore servicing system such as wellbore servicing system 100 comprising an ASA such as ASA 200, a wellbore servicing method employing such a wellbore servicing system 100 and/or such an ASA 200, or combinations thereof may be advantageously employed in the performance of a wellbore servicing operation. For example, as disclosed herein, as ASA such as ASA 200 may allow an operator to ascertain the configuration of such an ASA while the ASA remains disposed within the subterranean formation. As such, the operator can be assured that a given servicing fluid will be communicated to a given zone within the subterranean formation. Such assurances may allow the operator to avoid mistakes in the performance of various servicing operations, for example, communicating a given fluid to the wrong zone of a formation. In addition, the operator can perform servicing operations with the confidence that the operation is, in fact, reaching the intended zone.

ADDITIONAL DISCLOSURE

The following are nonlimiting, specific embodiments in accordance with the present disclosure:

Embodiment A

A wellbore servicing apparatus comprising:

a housing defining an axial flowbore and comprising one or more ports providing a route of fluid communication between the axial flowbore and an exterior of the housing;

a sliding sleeve disposed within the housing and comprising a seat and an orifice, the sliding sleeve being movable from a first position in which the ports are obstructed by the sliding sleeve to a second position in which the ports are unobstructed by the sliding sleeve, and the seat being configured to engage and retain an obturating member; and a fluid delay system comprising a fluid chamber containing a fluid, wherein the fluid delay system is operable to allow the sliding sleeve to transition from the first position to the second position at a delayed rate.

Embodiment B

The wellbore servicing apparatus of embodiment A, wherein the orifice of the sliding sleeve is not in fluid communication with the fluid chamber when the sliding sleeve is in the first position.

Embodiment C

The wellbore servicing apparatus of embodiment B, wherein the orifice of the sliding sleeve comes into fluid communication with the fluid chamber upon movement of the sliding sleeve from the first position in the direction of the second position.

Embodiment D

The wellbore servicing apparatus of embodiment A, B, or C, wherein the orifice is configured to allow at least a portion of the compressible fluid to escape from the fluid chamber at a controlled rate.

Embodiment E

The wellbore servicing apparatus of embodiment A, B, C, or D, wherein the wellbore servicing apparatus is configured such that an application of pressure to the sliding sleeve via an obturating member and the seat, a force is applied to the sliding sleeve in the direction of the second position.

Embodiment F

The wellbore servicing apparatus of embodiment E, wherein the wellbore servicing apparatus is configured such that the force causes the compressible fluid to be compressed.

Embodiment G

The wellbore servicing apparatus of embodiment A, B, C, D, E, or F, wherein the sliding sleeve is retained in the first position by a shear-pin.

Embodiment H

The wellbore servicing apparatus of embodiment A, B, C, D, E, F, or G, wherein the fluid has a bulk modulus in the range of from about 1.8 $10^5$ psi, $lb_f/in^2$ to about 2.8 $10^5$ psi, $lb_f/in^2$.

Embodiment I

The wellbore servicing apparatus of embodiment A, B, C, D, E, F, G, or H, wherein the compressible fluid comprises silicon oil.

Embodiment J

A wellbore servicing method comprising:

positioning a casing string within a wellbore, the casing string having incorporated therein a wellbore servicing apparatus, the wellbore servicing apparatus comprising:

a housing defining an axial flowbore and comprising one or more ports providing a route of fluid communication between the axial flowbore and an exterior of the housing;

a sliding sleeve disposed within the housing and comprising a seat and an orifice, the sliding sleeve being movable from a first position to a second position; and a fluid delay system comprising a fluid chamber containing a fluid;

transitioning the sliding sleeve from the first position in which the ports of the housing are obstructed by the sliding sleeve to the second position in which the ports of the housing are unobstructed by the sliding sleeve, wherein the fluid delay system causes the sliding sleeve to transition from the first position to the second position at a delayed rate, wherein the delayed rate of transition from the first position to the second position causes an elevation of pressure within casing string;

verifying that the sliding sleeve has transitioned from the first position to the second position; and communicating a wellbore servicing fluid via the ports.

Embodiment K

The wellbore servicing method of embodiment J, wherein transitioning the sliding sleeve from the first position to the second position comprises:

introducing an obturating member into the casing string;

flowing the obturating member through the casing string to engage the seat within the wellbore servicing apparatus;

applying a fluid pressure to the sliding sleeve via the obturating member and the seat.

Embodiment L

The wellbore servicing method of the embodiment K, wherein applying the fluid pressure to the sliding sleeve results in a force applied to the sliding sleeve in the direction of the second position.

Embodiment M

The wellbore servicing method of embodiment L, where the force applied to the sliding sleeve in the direction of the second position causes the sliding sleeve to move in the direction of the second position and compresses the compressible fluid within the fluid chamber.

Embodiment N

The wellbore servicing method of embodiment M, wherein the orifice is not in fluid communication with the fluid chamber when the sliding sleeve is in the first position.

Embodiment O

The wellbore servicing method of embodiment N, wherein movement of the sliding sleeve a distance from the first position in the direction of the second position causes the orifice to come into fluid communication with the fluid chamber.

Embodiment P

The wellbore servicing method of embodiment O, wherein the compressible fluid is allowed to escape from the fluid chamber via the orifice after the orifice comes into fluid communication with the fluid chamber.

Embodiment Q

The wellbore servicing method of embodiment J, K, L, M, N, O, or P, wherein verifying that the sliding sleeve has transitioned from the first position to the second position comprises observing the elevation of pressure within the casing string.

Embodiment R

The wellbore servicing method of embodiment J, K, L, M, N, O, P, or Q, wherein the elevation of pressure within the casing string dissipates upon the sliding sleeve reaching the second position.

Embodiment S

The wellbore servicing method of embodiment R, wherein verifying that the sliding sleeve has transitioned from the first position to the second position comprises observing the elevation of pressure within the casing string followed by the dissipation of the elevated pressure from the casing string.

Embodiment T

The wellbore servicing method of embodiment S, wherein verifying that the sliding sleeve has transitioned from the first position to the second position comprises observing the elevation of pressure to at least a threshold magnitude.

Embodiment U

The wellbore servicing method of embodiment S, wherein verifying that the sliding sleeve has transitioned from the first position to the second position comprises observing the elevation of pressure for at least a threshold duration.

Embodiment V

A wellbore servicing method comprising:

activating a wellbore servicing apparatus by transitioning the wellbore servicing apparatus from a first mode to a second mode, wherein the wellbore servicing apparatus is configured to transition from the first mode to the second mode at a delayed rate and to cause an elevation of pressure within a flowbore of the wellbore servicing apparatus; and detecting the elevation of the pressure within the flowbore, wherein detection of the elevation of the pressure within the flowbore for a predetermined duration, to a predetermined magnitude, or both serves as an indication that the wellbore servicing apparatus is transitioning from the first mode to the second mode.

Embodiment W

The wellbore servicing method of embodiment V, further comprising:

communicating a wellbore servicing fluid via the wellbore servicing apparatus.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore servicing apparatus comprising:

a housing defining an axial flowbore and comprising one or more ports providing a route of fluid communication between the axial flowbore and an exterior of the housing;

a sliding sleeve disposed within the housing and comprising a seat, the sliding sleeve being movable from a first position in which the ports are obstructed by the sliding sleeve to a second position in which the ports are unobstructed by the sliding sleeve, and the seat being configured to engage and retain an obturating member; and a fluid delay system comprising a fluid chamber substantially defined by the housing of the sliding sleeve and an orifice disposed within the sliding sleeve, wherein the orifice of the sliding sleeve is not in fluid communication with the fluid chamber when the sliding sleeve is in the first position, wherein the orifice of the sliding sleeve comes into fluid communication with the fluid chamber upon movement of the sliding sleeve from the first position in the direction of the second position, and wherein the fluid chamber contains a compressible fluid, wherein the fluid delay system is operable to allow the sliding sleeve to transition from the first position to the second position at a delayed rate.

2. The wellbore servicing apparatus of claim 1, wherein the orifice is configured to allow at least a portion of the compressible fluid to escape from the fluid chamber at a controlled rate.

3. The wellbore servicing apparatus of claim 1, wherein the wellbore servicing apparatus is configured such that an application of pressure to the sliding sleeve via the obturating member and the seat, a force is applied to the sliding sleeve in the direction of the second position.

4. The wellbore servicing apparatus of claim 3, wherein the wellbore servicing apparatus is configured such that the force causes the compressible fluid to be compressed.

5. The wellbore servicing apparatus of claim 1, wherein the sliding sleeve is retained in the first position by a shear-pin.

6. The wellbore servicing apparatus of claim 1, wherein the fluid has a bulk modulus in the range of from about 1.8 $10^5$ psi, $lb_f/in^2$ to about 2.8 $10^5$ psi, $lb_f/in^2$.

7. The wellbore servicing apparatus of claim 1, wherein the compressible fluid comprises silicon oil.

8. The wellbore servicing apparatus of claim 1, wherein the orifice does not provide a route of fluid communication between the fluid chamber and the axial flowbore when the sliding sleeve is in the first position.

9. The wellbore servicing apparatus of claim 8, wherein the orifice provides the route of fluid communication between the fluid chamber and the axial flowbore upon movement of the sliding sleeve from the first position in the direction of the second position.

10. A wellbore servicing method comprising:

positioning a casing string within a wellbore, the casing string having incorporated therein a wellbore servicing apparatus, the wellbore servicing apparatus comprising:

a housing defining an axial flowbore and comprising one or more ports providing a route of fluid communication between the axial flowbore and an exterior of the housing;

a sliding sleeve disposed within the housing and comprising a seat, the sliding sleeve being movable from a first position to a second position; and a fluid delay system comprising a fluid chamber substantially defined by the housing of the sliding sleeve and an orifice disposed within the sliding sleeve, wherein the fluid chamber contains containing a compressible fluid;

transitioning the sliding sleeve from the first position in which the ports of the housing are obstructed by the sliding sleeve and the orifice of the sliding sleeve is not in fluid communication with the fluid chamber when the sliding sleeve is in the first position to the second position in which the ports of the housing are unobstructed by the sliding sleeve and the orifice of the sliding sleeve comes into fluid communication with the fluid chamber upon movement of the sliding sleeve from the first position in the direction of the second position, wherein the fluid delay system causes the sliding sleeve to transition from the first position to the second position at a delayed rate, wherein the delayed rate of transition from the first position to the second position causes an elevation of pressure within casing string;

verifying that the sliding sleeve has transitioned from the first position to the second position; and communicating a wellbore servicing fluid via the ports.

11. The wellbore servicing method of claim 10, wherein transitioning the sliding sleeve from the first position to the second position comprises:

introducing an obturating member into the casing string;

flowing the obturating member through the casing string to engage the seat within the wellbore servicing apparatus;

applying a fluid pressure to the sliding sleeve via the obturating member and the seat.

12. The wellbore servicing method of the claim 11, wherein applying the fluid pressure to the sliding sleeve results in a force applied to the sliding sleeve in the direction of the second position.

13. The wellbore servicing method of claim 12, where the force applied to the sliding sleeve in the direction of the second position causes the sliding sleeve to move in the direction of the second position and compresses the compressible fluid within the fluid chamber.

14. The wellbore servicing method of claim 10, wherein the compressible fluid is allowed to escape from the fluid chamber via the orifice after the orifice comes into fluid communication with the fluid chamber.

15. The wellbore servicing method of claim 10, wherein verifying that the sliding sleeve has transitioned from the first position to the second position comprises observing the elevation of pressure within the casing string.

16. The wellbore servicing method of claim 10, wherein the elevation of pressure within the casing string dissipates upon the sliding sleeve reaching the second position.

17. The wellbore servicing method of claim 16, wherein verifying that the sliding sleeve has transitioned from the first position to the second position comprises observing the elevation of pressure within the casing string followed by the dissipation of the elevated pressure from the casing string.

18. The wellbore servicing method of claim 17, wherein verifying that the sliding sleeve has transitioned from the first position to the second position comprises observing the elevation of pressure to at least a threshold magnitude.

19. The wellbore servicing method of claim 17, wherein verifying that the sliding sleeve has transitioned from the first position to the second position comprises observing the elevation of pressure for at least a threshold duration.

20. The wellbore servicing method of claim 10, wherein the orifice does not provide a route of fluid communication between the fluid chamber and the axial flowbore when the sliding sleeve is in the first position.

21. The wellbore servicing method of claim 20, wherein movement of the sliding sleeve a distance from the first position in the direction of the second position causes the orifice to provide the route of fluid communication between the fluid chamber and the axial flowbore.

22. A wellbore servicing method comprising:

positioning a tubular sting having a flowbore within a wellbore, wherein the tubular string has incorporated therein a wellbore servicing apparatus;

transitioning the wellbore servicing apparatus from a first mode to a second mode, wherein transitioning the wellbore servicing apparatus from the first mode to the second mode comprises:

introducing an obturating member into the tubular string;

flowing the obturating member through the flowbore of the tubular string engage a seat associated with the wellbore servicing apparatus; and applying a fluid pressure via the obturating member and the seat;

wherein the wellbore servicing apparatus is configured to transition from the first mode to the second mode at a delayed rate and to cause an elevation of pressure within a flowbore of the wellbore servicing apparatus; and detecting the elevation of the pressure within the flowbore, wherein detection of the elevation of the pressure within the flowbore for a predetermined duration, to a predetermined magnitude, or both serves as an indication that the wellbore servicing apparatus is transitioning from the first mode to the second mode.

23. The wellbore servicing method of claim 22, further comprising:

communicating a wellbore servicing fluid via the wellbore servicing apparatus.

* * * * *